US010058162B2

(12) United States Patent
Tebbe et al.

(10) Patent No.: US 10,058,162 B2
(45) Date of Patent: Aug. 28, 2018

(54) SNAP-LOCK HANDLE FOR STRAPS

(71) Applicant: MUNCHKIN, INC., Van Nuys, CA (US)

(72) Inventors: Mark Gerard Tebbe, Ventura, CA (US); Ruth Hsin-Ju Fang, Monterey Park, CA (US); Quinn Biesinger, Provo, UT (US)

(73) Assignee: Munchkin, Inc., Van Nuys, CA (US)

( * ) Notice: Subject to any disclaimer, the term of this patent is extended or adjusted under 35 U.S.C. 154(b) by 0 days.

(21) Appl. No.: 14/201,679

(22) Filed: Mar. 7, 2014

(65) Prior Publication Data

US 2014/0250632 A1 Sep. 11, 2014

Related U.S. Application Data

(60) Provisional application No. 61/775,410, filed on Mar. 8, 2013.

(51) Int. Cl.

| | |
|---|---|
| ***A44B 11/26*** | (2006.01) |
| ***A45F 3/02*** | (2006.01) |
| ***A45C 13/26*** | (2006.01) |

(52) U.S. Cl.

CPC ..... *A45F 3/02* (2013.01); *A44B 11/266* (2013.01); *A45C 13/26* (2013.01); *Y10T 16/4576* (2015.01)

(58) Field of Classification Search

CPC ..... A44B 11/266; A44B 11/26; A44C 13/26
USPC ..... 24/614, 615
See application file for complete search history.

(56) References Cited

U.S. PATENT DOCUMENTS

| | | | | |
|---|---|---|---|---|
| 4,825,515 | A * | 5/1989 | Wolterstorff, Jr. | 24/625 |
| 5,380,067 | A * | 1/1995 | Turvill et al. | 297/484 |
| 5,584,105 | A * | 12/1996 | Krauss | 24/614 |
| 5,778,498 | A * | 7/1998 | Laks | 24/625 |
| 5,794,316 | A * | 8/1998 | Anscher | 24/625 |
| 5,953,798 | A * | 9/1999 | Matoba | A44B 11/266 24/615 |
| 6,460,232 | B2 * | 10/2002 | Maruoka | 24/615 |
| 6,757,944 | B2 * | 7/2004 | Buscart | 24/614 |
| 7,089,633 | B2 * | 8/2006 | Liu | 24/615 |
| 7,426,771 | B2 * | 9/2008 | Patrizi et al. | 24/307 |
| 7,430,789 | B2 * | 10/2008 | Wright | 24/615 |
| 7,685,685 | B2 * | 3/2010 | Giampavolo | 24/614 |
| 2013/0097825 | A1 * | 4/2013 | McCauley et al. | 24/589.1 |

* cited by examiner

*Primary Examiner* — Emily M Morgan
(74) *Attorney, Agent, or Firm* — Robert Z. Evora, Esq.; Christian Lek

(57) ABSTRACT

A handle device for a strap having a clip and a receiving element disposed within a grip. The clip lockingly engages the grip. The combined structure of the clip and grip forms a slightly curved handle adapted for a user to carry a container by comfortably clasping the handle.

16 Claims, 10 Drawing Sheets

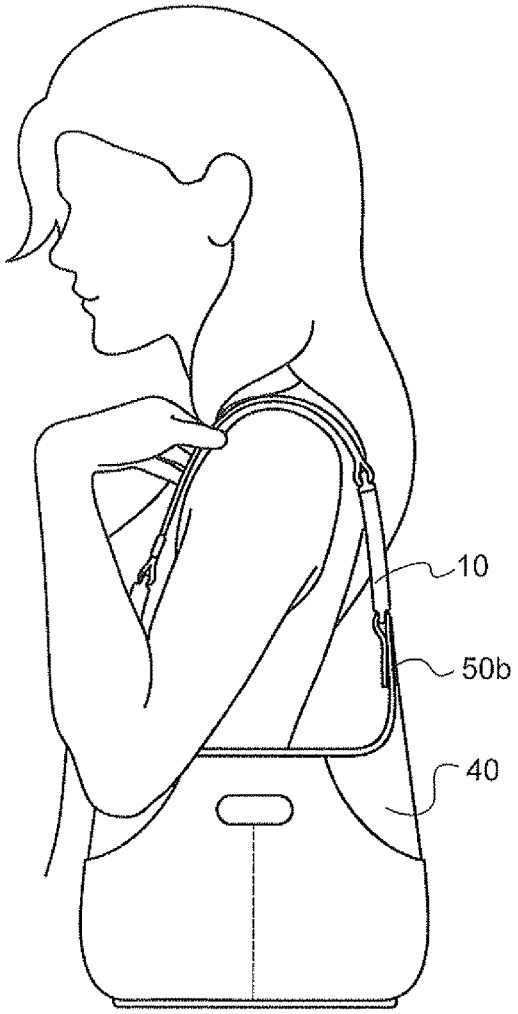
FIG. 10
FIG. 11
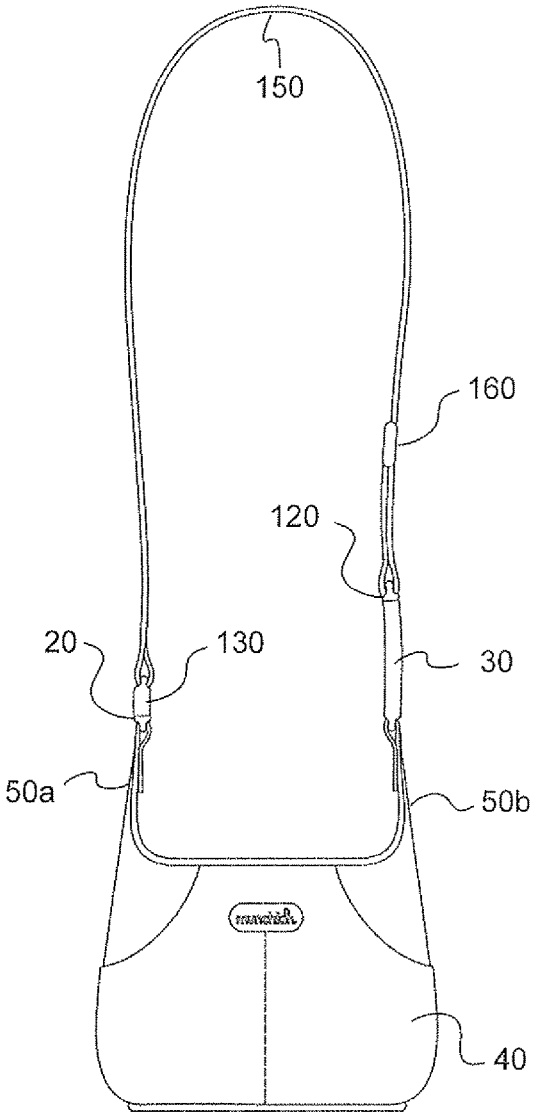

SNAP-LOCK HANDLE FOR STRAPS

CROSS REFERENCE TO RELATED APPLICATION

This application claims priority to U.S. Provisional Application Ser. No. 61/775,410 filed Mar. 8, 2013; the contents of all of which are hereby incorporated by reference herein in their entirety into this disclosure.

TECHNICAL FIELD

The subject disclosure relates to a handle having an integrated snap-lock fastening device.

BACKGROUND

Conventionally, various straps have incorporated snap-lock buckles as a mechanism for opening and closing a strap on an object, such as a backpack. However, previously, these closure mechanisms were only devised as buckles and were not provided for any other purpose. These buckles typically have sharp edges and are intended for grabbing onto when carrying an object, such as a bag 140. To the contrary, the center of the strap was grabbed onto by the user.

For example, FIG. 16 shows a conventional illustration of a bag 140 being carried by a user about the conventional strap 250. Clearly, the weight of the items disposed in the heavy bag 140 causes the strap 250 to painfully cut into the user hand 105. Likewise, the lack of rigidity in the straps 250 contributes to the straps 250 uncomfortably digging into the user's hand 105 over substantial periods of time.

BRIEF DESCRIPTION OF THE DRAWINGS

Various exemplary embodiments of this disclosure will be described in detail, wherein like reference numerals refer to identical or similar components or steps, with reference to the following figures, wherein:

FIG. 10 shows the handle in use with a strap extension.

FIG. 11 depicts the strap extension added to the strap connected to the handle.

DETAILED DESCRIPTION

Figure 1:
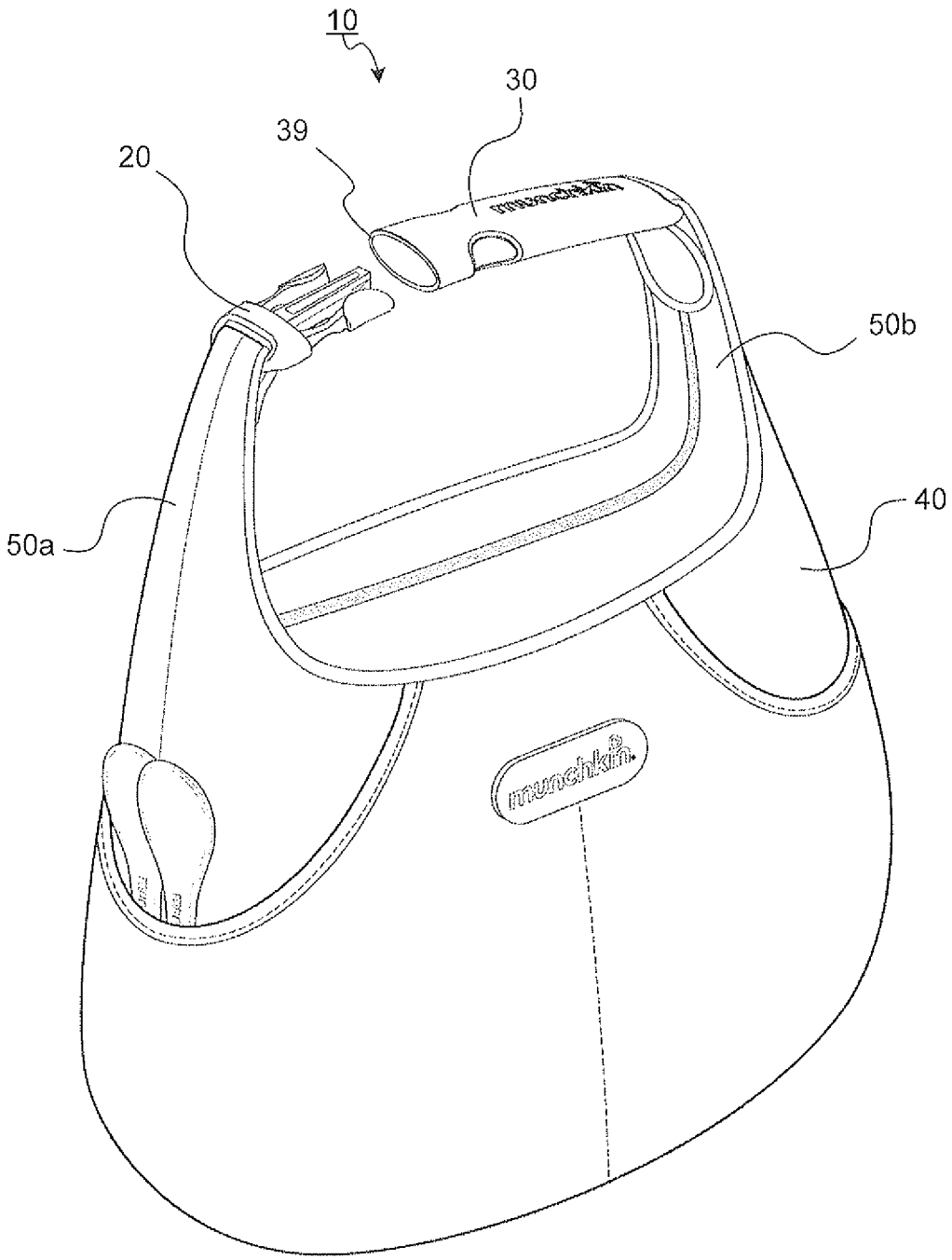
FIG. 1 illustrates a perspective view of an exemplary handle for a container according to the subject disclosure.
Figure 2:
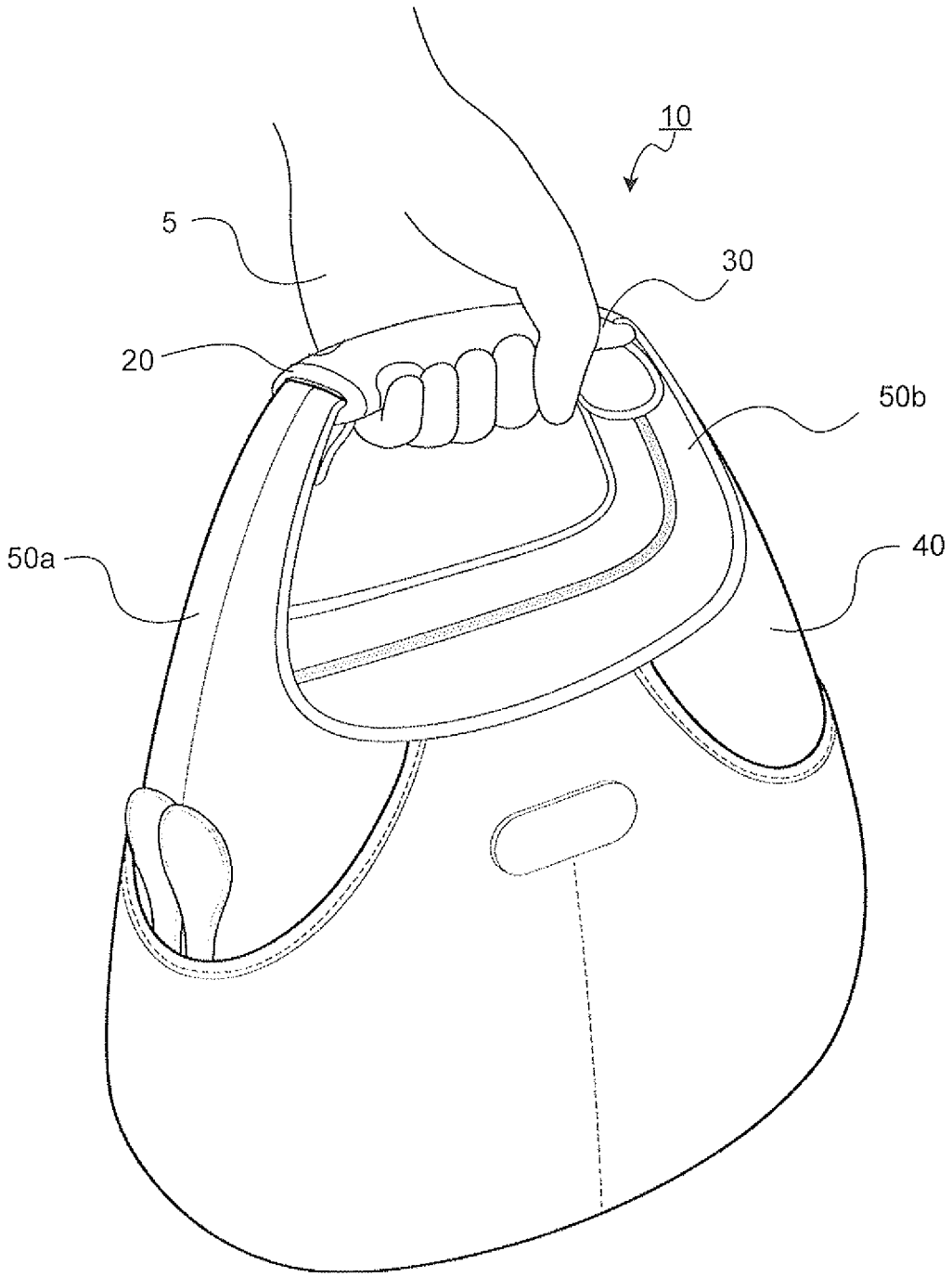
FIG. 2 shows another perspective view of the handle being comfortably held by a user.

Particular embodiments of the present invention will now be described in greater detail with reference to the figures.

FIGS. 1-6 show a handle 10 for a container 40 having an integrated fastening device disposed therein. In more detail, the handle 10 includes a male portion being a clip 20, and a female receiving portion being a recessed compartment 34 in a grip 30. The clip 20 is matingly engaged and secured within the recessed compartment 34.

Figure 3:
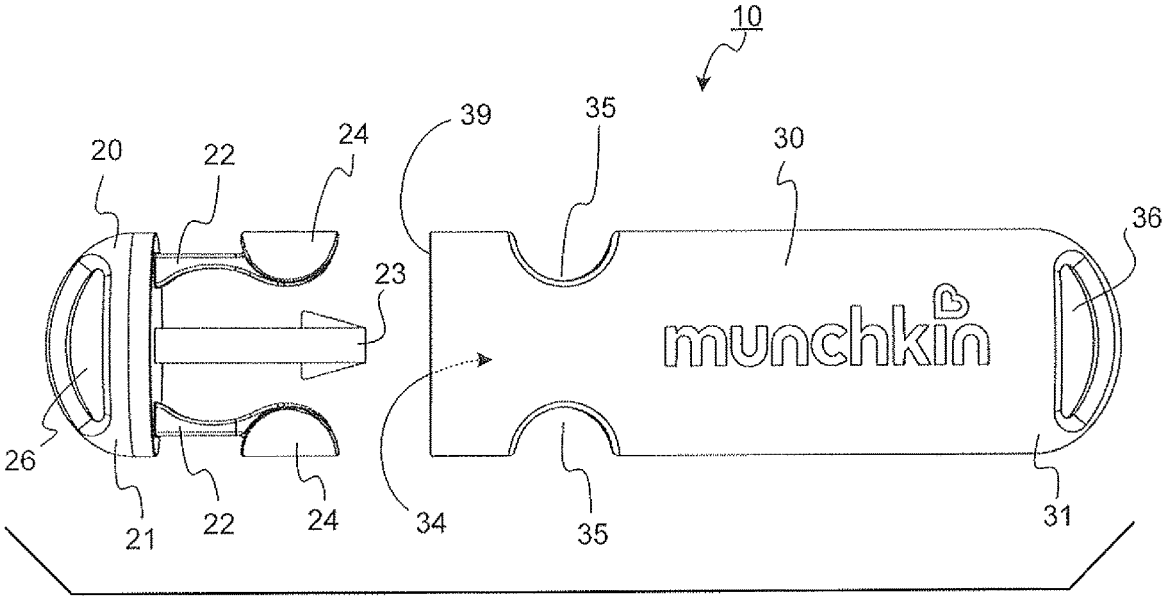
FIG. 3 is an exploded view of the handle in an open position.
Figure 4:
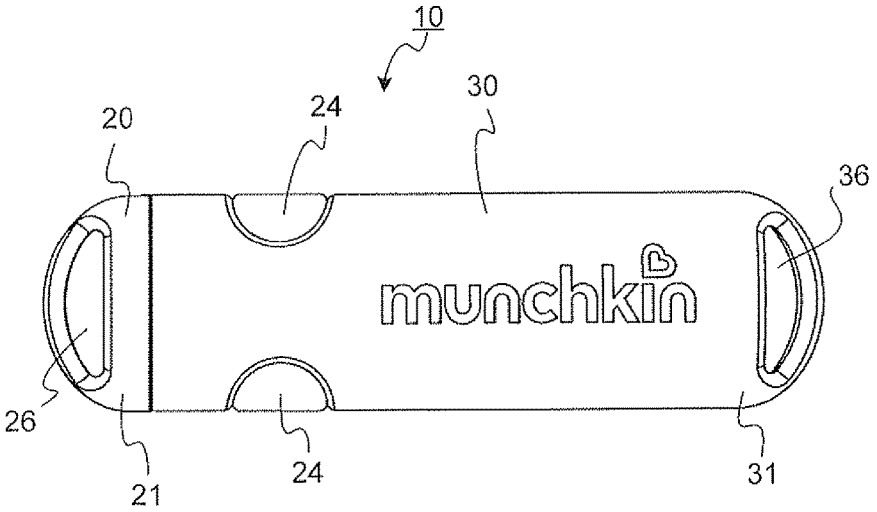
FIG. 4 depicts the handle in a closed position.

As shown in FIGS. 1 and 3-4, the clip 20 includes a first strap 50*a* receiving opening 26 in the base 21. Likewise, the grip 30 includes a second strap 50*b* receiving opening 36 disposed at an opposite end in its base 31.

As shown in FIG. 3, the clip 20 includes a pair of resilient snap-type hooks 22 that extend from a base 21 at a first end. A pair of locking elements 24 is disposed at a second end of the hooks 22. In use, the pair of resilient snap-type hooks 22 acts as springs.

Figure 5:
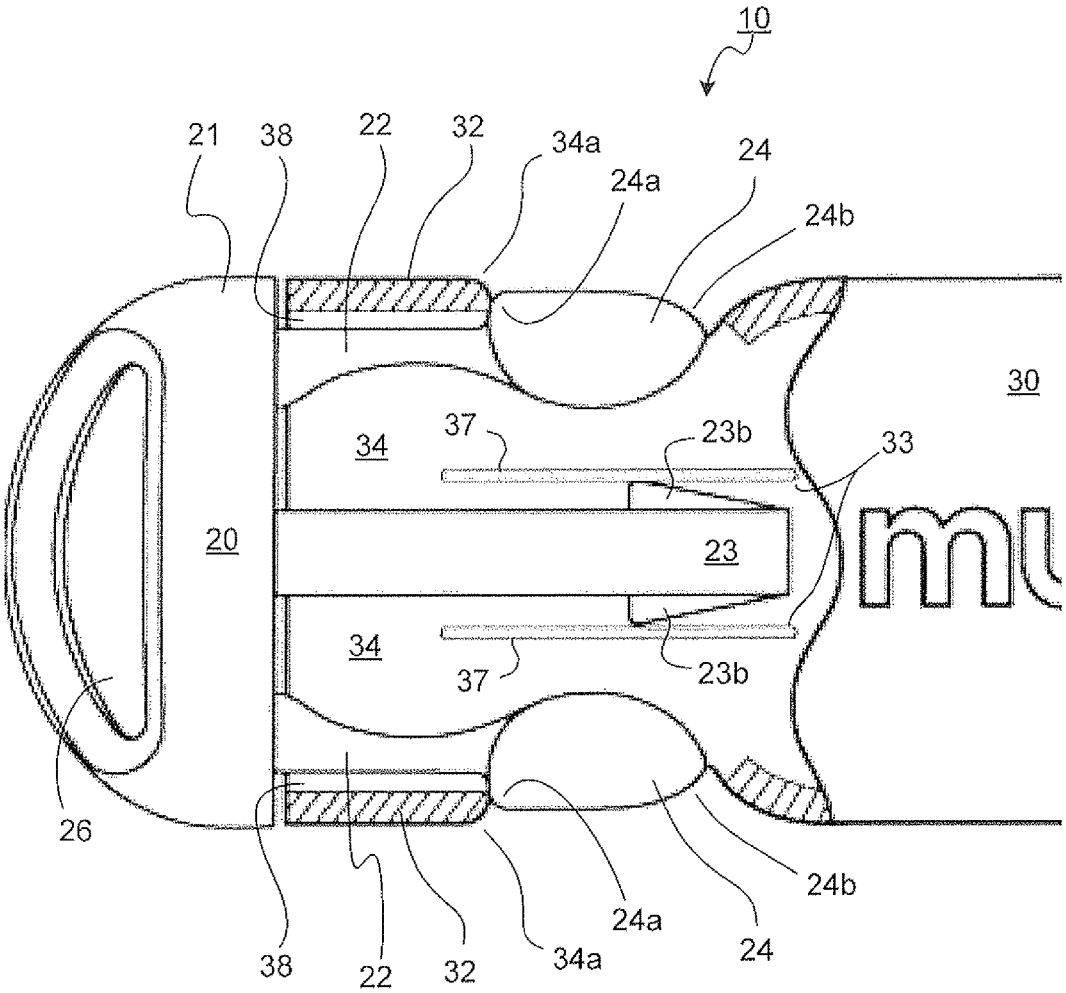
FIG. 5 shows a partial cross section view of the handle.

As shown in partial cross section view in FIG. 5, the clip 20 is adapted to be inserted into the recessed compartment 34 in the grip 30. The outermost edges 24*b* of the locking elements 24 are contoured with a curve to be pushed inward by the narrow internal wall 32 contour within the recessed compartment 34. The outermost edges 24*b* of the locking elements 24 are curved and contoured to deflect the edges 24*b* of the locking elements 24 toward each other along the narrowed track 32 within the grip 30.

The resilient nature of the snap-type hooks 22 is such that they are biased to push back outward to return to their unbiased outward position as shown in FIG. 3. Once the inner edge 24*a* of the locking elements 24 travels past the edge of an undercut 34*a* in the internal wall 32, the locking elements 24 will snap outward and lock into a pair of mating apertures 35. The pair of mating apertures 35 is provided in the grip 30 and are sized and configured to receive the locking elements 24.

Referring to FIG. 5, the recessed compartment 34 may have various inwardly guiding rib-like contours or inclined surfaces 37, 38 which are adapted to engage the various surfaces on the resilient snap-type hooks 22 and/or the surfaces on the projection 23 in order to align and guide the clip 20 into an opening 39 in the recessed compartment 34 (as shown in FIG. 1). The inclined surfaces 37, 38 generates a force on the resilient snap-type hooks 22 and cause the resilient snap-type hooks 22 to deflect inward from its rest position to fit and slide within the internal walls 32 of the recessed compartment 34.

A center projection 23 extends outward from the base 21 of the clip 20. The projection 23 may be constructed to extend central to the pair of resilient snap-type hooks 22. The projection 23 is a guide that centers the clip 20 within the grip 30. A mating opening 33 (see FIG. 5) may be integrated within the recessed compartment 34 to receive the peripheral end of the projection 23. The various surfaces 23*b* on the projection 23 can be dimensioned to substantially correspond to the mating opening 33 formed within the grip 30.

Figure 6:
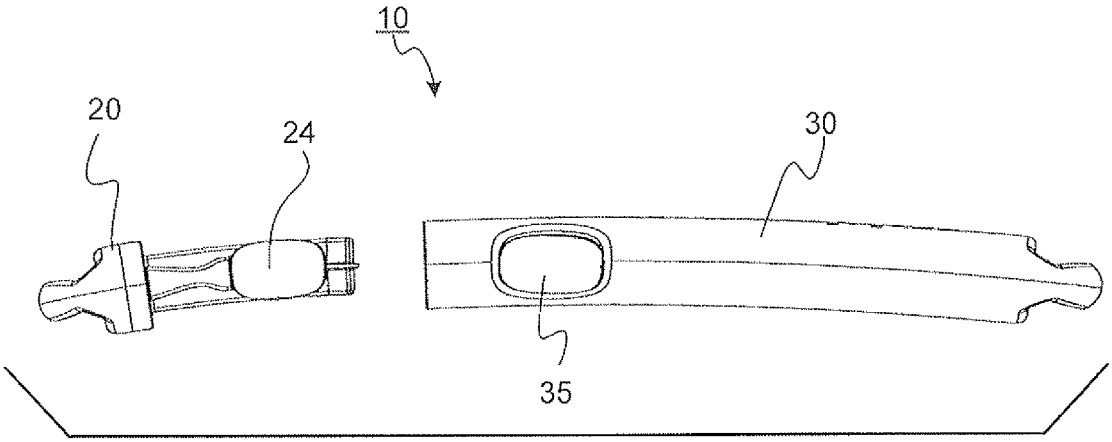
FIG. 6 is an exploded side view of the handle in an open position.
Figure 7:
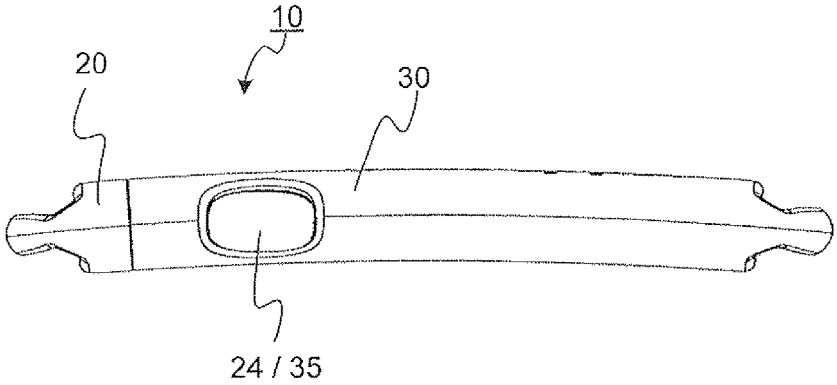
FIG. 7 illustrates the handle in a closed position.

As shown in FIGS. 6-7, the handle 10 can be constructed to have a slight radius of curvature to its structure. The curvature is beneficial for various reason, such as to enhance the ergonomic comfort to a person who is carrying the container 40 by the handle 10. Likewise, if the user decides to carry the handle over their shoulder, the curvature of the handle 10 and the adjacent straps 50*a*, 50*b* provide comfortable use over the users shoulder. As shown, the internal structure of the clip 20 may also contain a similar radius of curvature to mate with the curvature of the grip 30.

Although embodied as a snap-type locking mechanism, it is to be understood that the handle can be constructed with various other types of study locking mechanisms.

Referring to FIG. 5, locking of the clip 20 in the recessed compartment 34 takes place by insertion. That is, the user guides the rounded ends 24*b* of the resilient snap-type hooks 22 of the clip 20 into the opening 39 of the recessed compartment 34. When the clip 20 is inserted into the recessed compartment 34, the hooks 22 slide along corresponding internal surfaces 38 along the opening of the recessed compartment 34. The hooks 22 are briefly deflected inward toward each other by a wedge and lever action. The locking elements 24 of the hooks 22 slide until they pass the undercut 34*a* in the recessed compartment 34, at which time the locking elements snap over the undercut 34*a* formed in the recessed compartment 34 and lock its end 24*a* into place within the aperture 35 in the grip 30.

When the locking elements 24 of the clip 20 are locked in the receiving apertures 35, a secure connection is created that cannot simply be released by pulling the clip 20 back outward from the grip 30. In order to release the connection, the locking elements 24 on the hooks 22 must be depressed by a user pressing both of the locking elements 24 simultaneously inward toward each other through the apertures 35. Inward pressure is applied as the clip is pulled until the locking elements 24 compress inward enough for the end 24*a* of the locking elements 24 to clear the undercut 34*a* formed in the recessed compartment 34. The clip 20 can then be pulled back out of the recessed compartment 34 in the grip 30. As the clip 20 is pulled backward, the locking elements 24 and hooks 22 are held deflected inward by the inner wall 32 of the recessed compartment 34. Likewise, the deflection is caused by a lever or wedge action exerted by the locking elements 24 sliding over the inclined surfaces 32 within the grip 30.

Figure 14:
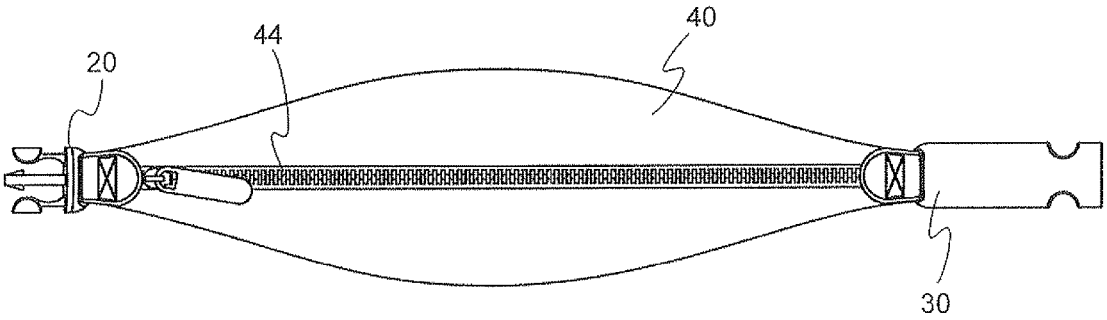
FIG. 14 is a top view of the handle in an open state permitting access to an opening in the container.

As shown in FIG. 14, when the clip 20 is released from the grip 30, a user can access an opening 44 in the container 40. The container 40 may use any type of closure mechanism, such as a zipper 42 used to secure the opening 44 of the container 40 closed.

The edges 24*a* of the locking elements 24 of the resilient snap-type hooks 22 take up a secure engagement behind the undercut 34*a* arranged on both sides of the internal walls 32 in the recessed compartment 34. The snap-type hooks 22 and the locking elements 24 may each have various inclined surfaces 24*b* to facilitate in the moving action of the hooks 22.

The projection 23 of the clip 20 may also have inclined surfaces 23*b* that cooperate with the guide surfaces 37 within the recessed compartment 34. When the clip 20 releases its connection of the locking elements 24 at the undercut 34*a* in the recessed compartment 34, the clip 20 can be removed out of and away from within the grip 30.

For assembling, the clip 20 is pushed into the opening 39 of the recessed compartment 34. The hooks 22 and the projection 23 are guided over the inclined surfaces 37, 38 within the recessed compartment 34. As the snap-type hooks 22 are guided and slide within the recessed compartment 34, the snap-type hooks 22 are elastically deformed and urged slightly together. Once the edge 24*a* of the locking elements 24 pass the undercut 34*a* in the recessed compartment 34, the locking elements 24 snap outward into the aperture 35 in the grip 30. The clip 20 and the recessed compartment 34 may be constructed symmetrically so that the connection can be carried out with two different orientations in the receiving slide pocket 34.

Any widely used material can be used to construct the handle, such as but not limited to for example POM, PC or PA and/or other polymer, composite or other suitable material can be used. Likewise, other soft coatings can be applied to the outer surface of the handle, such as for example, a coating or haptic element as a soft component which completely or partially surrounds the outer surface of the handle 10. It is to be understood that this handle 10 of this subject disclosure can be used in a variety of different ways and with various other components and/or fields.

Figure 8:
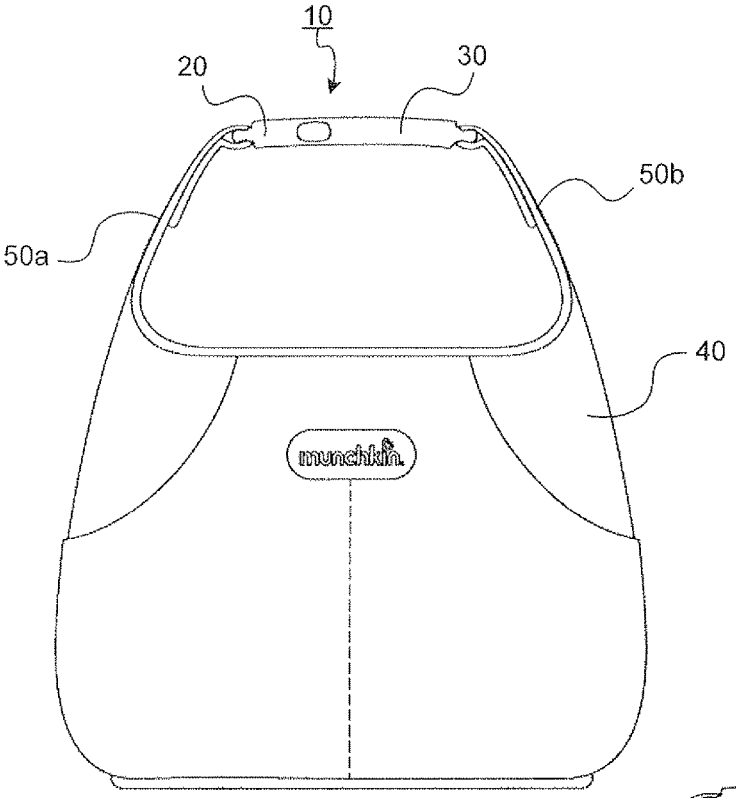
FIGS. 8-9 depict a front and rear view of the handle used with a container.
Figure 9:
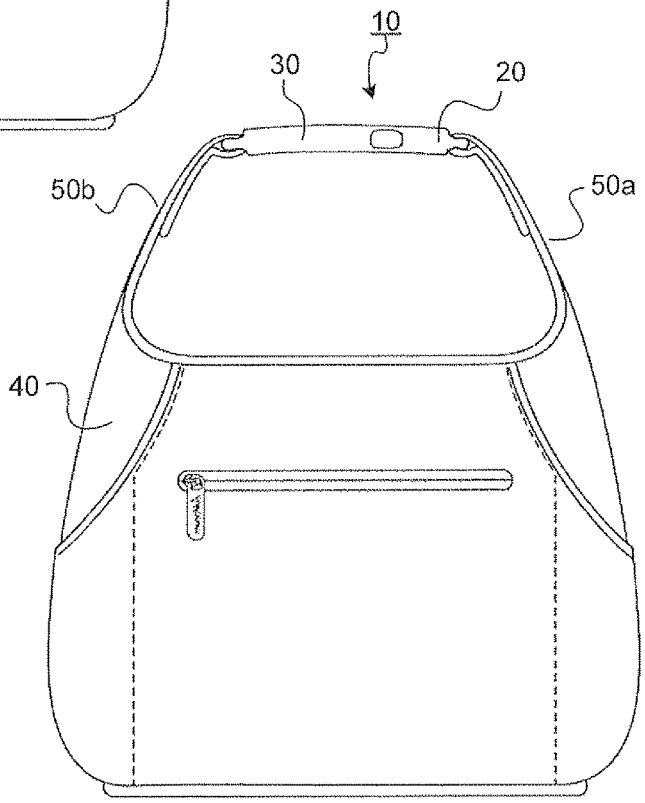
Figure 12:
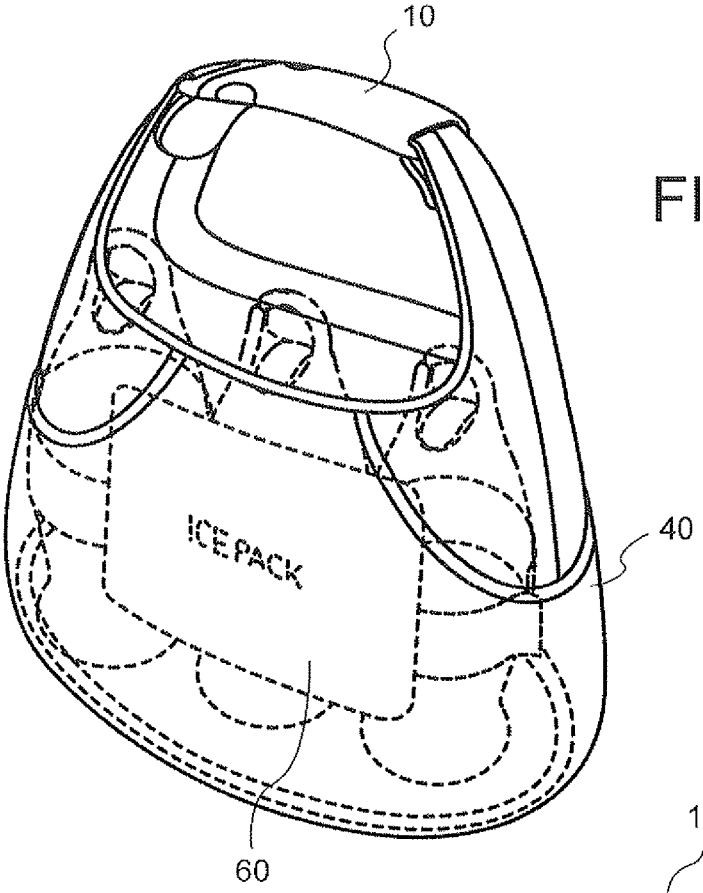
FIG. 12 illustrates the handle for use with an insulated container.
Figure 13:
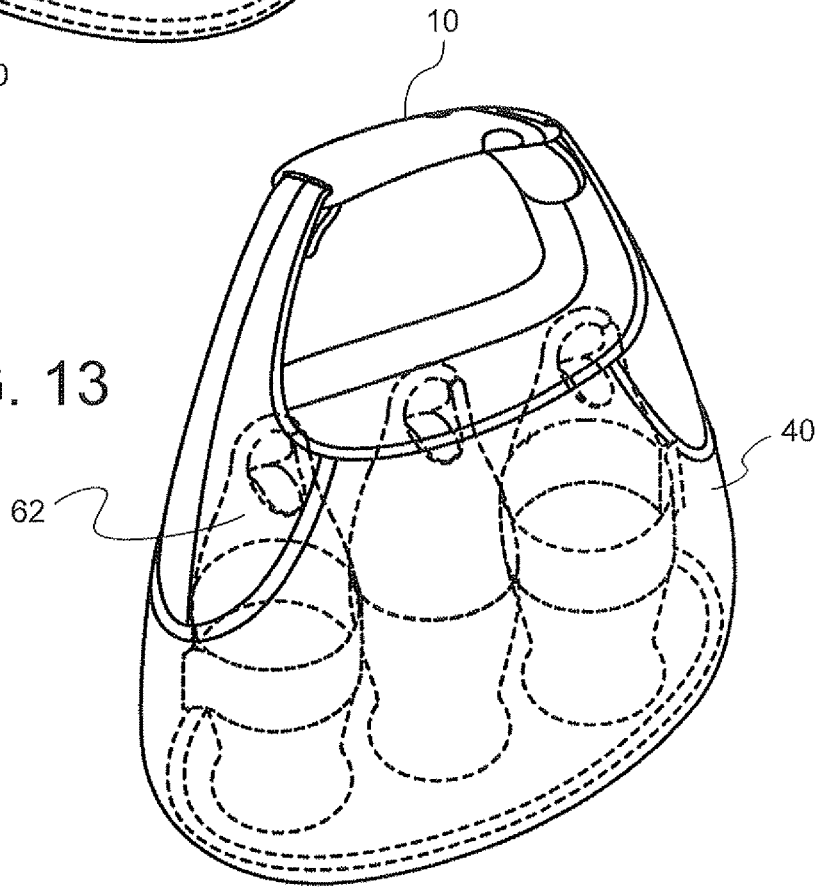
FIG. 13 shows the handle for use with a bottle carrying container.

For example, FIGS. 8-9 depict a front and rear view of the handle used with a container 40. As shown in FIGS. 12-13, the container 40 may be used to carry an insulated container adapted to receive a cold or hot pack 60 therein. In FIG. 13, the handle 10 may be used in combination with a container 40 adapted to store and carry various bottles 62.

Figure 15:
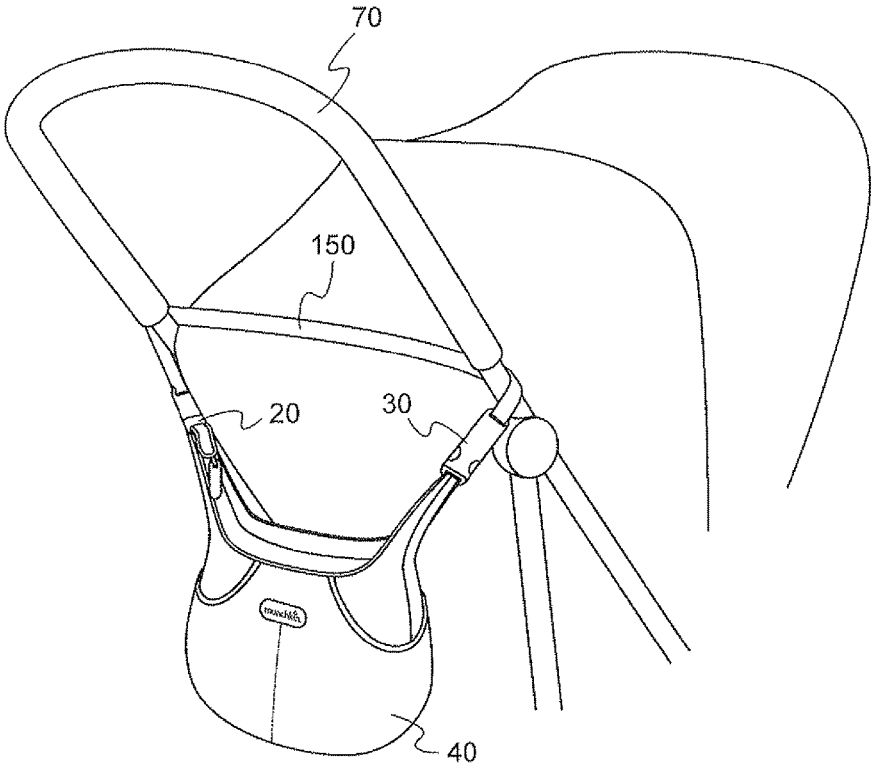
FIG. 15 illustrates the handle integrated for use with a strap extension and being adapted for use with an infant carrier.
Figure 16:
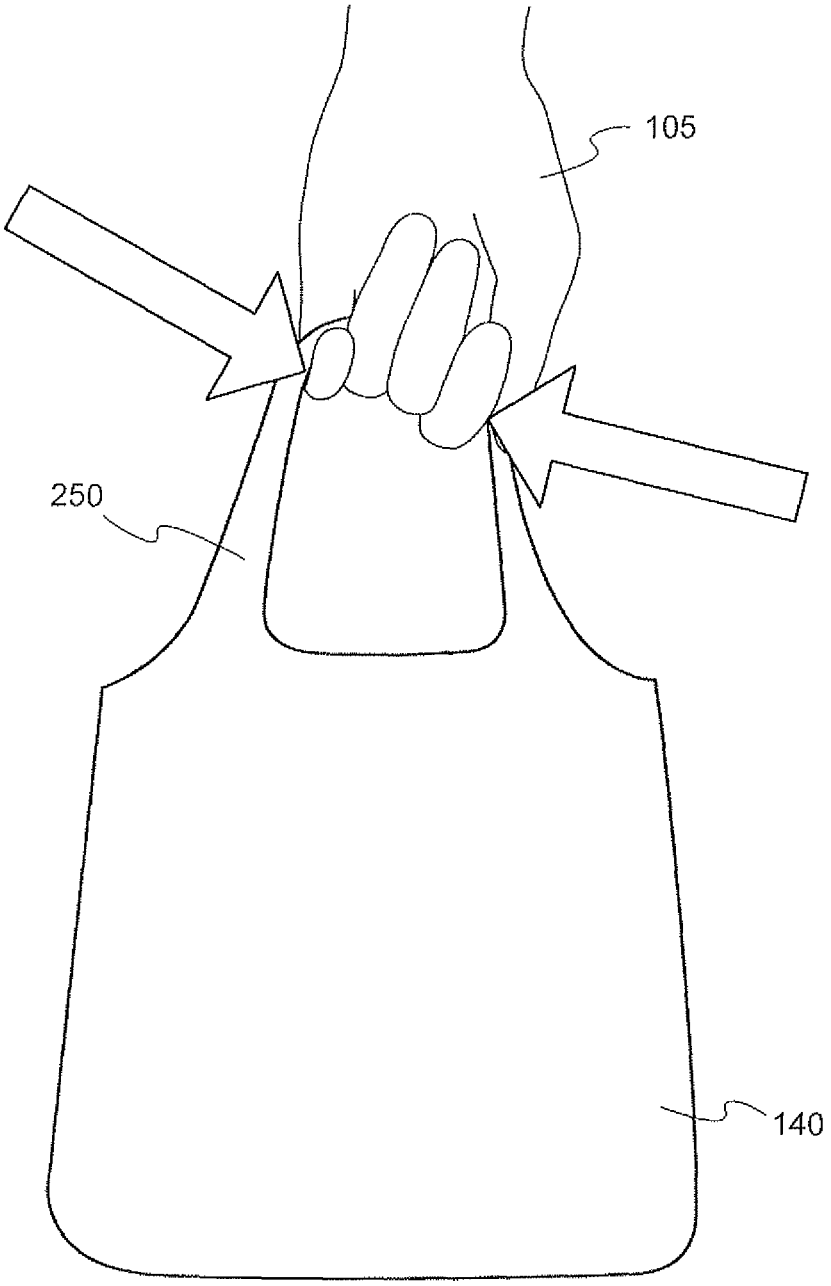
FIG. 16 shows a conventional bag and flexible strap painfully cutting into a user's hand.

Referring back to FIGS. 10-11 and 15, the handle 10 may adapted for use with various extension straps 150. In FIG. 11, the strap extension 150 may be integrated for use with the handle 10. That is, the clip 20 may be received by a female component 130 adapted in the strap extension 150 and the grip 30 of the handle 10 may be adapted to be received by a male component 120 on the strap extension 150. In use, the strap 50*a*, 50*b* on the handle 10 can be effectively extended for various other uses, such as to be carried as a purse or the like. In FIG. 15, the strap extension 150 is beneficial for securing the container 40 to an infant carrier 70.

The illustrations and examples provided herein are for explanatory purposes and are not intended to limit the scope of the appended claims. It will be recognized by those skilled in the art that changes or modifications may be made to the above described embodiment without departing from the broad inventive concepts of the invention. It is understood therefore that the invention is not limited to the particular embodiment which is described, but is intended to cover all modifications and changes within the scope and spirit of the invention.

The invention claimed is:

1. A handle for a strap, comprising:

a clip having a first strap receiving opening at a first distal end, and a base with a center projection extending outward therefrom, the center projection having opposing inclined surfaces; and a grip having rounded edges and a length substantially long enough to be received a palm of a user, the grip having an internal recessed compartment having internal guide surfaces disposed within the grip, the grip having a second strap receiving opening at a second distal end, wherein the first and the second strap receiving openings are bisected by a first plane having a longitudinal axis connecting center points of the first opening and the second opening, wherein when the clip is lockingly engaged to the grip, the inclined surfaces of the center projection of the clip cooperate with the internal guide surfaces within the grip, and a combined structure of the clip and the grip forms a slight radius of curvature disposed along a second curved planar surface that is substantially perpendicular to the first plane, wherein the slight radius of curvature of the handle and the rounded edges are ergonomic and comfortably received in the palm of the user.

2. The handle as recited in claim 1, wherein the clip comprises a pair of snap-type hooks extending from the base, the pair of snap-type hooks having a pair of locking elements disposed at an end thereof.

3. The handle as recited in claim 2, wherein the internal recessed compartment comprises mating apertures which are adapted to receive the locking elements of the snap-type hooks when the clip is lockingly engaged to the grip.

4. The handle as recited in claim 3, wherein the internal recessed compartment further comprises an internal surface adapted to engage the snap-type hooks to align and guide the clip into the internal recessed compartment.

5. The handle as recited in claim 4, wherein the internal surface deflects the snap-type hooks inward to fit and slide within the internal recessed compartment.

6. The handle as recited in claim 1, wherein the internal recessed compartment further comprises a pair of mating apertures, wherein the guide surfaces engage the center projection to properly align the snap-type hooks with the mating apertures.

7. The handle as recited in claim 1, wherein the clip contains a radius of curvature substantially equal to the radius of curvature of the grip along the second curved planar surface substantially perpendicular to the first flat planar surface having the longitudinal axis.

8. The handle as recited in claim 1, further comprising a strap extension having an extension clip at a first end and an extension grip at a second end, wherein the extension clip lockingly engages the grip and the extension grip lockingly engages the clip.

9. A curved handle for a strap, comprising:

a clip having a pair of snap-type hooks and a first strap receiving opening, and a base with a center projection extending outward therefrom, the center projection having opposing inclined surfaces; and a grip having rounded edges and a length substantially long enough to be received by a palm of a user, the grip having a recessed compartment having internal guide surfaces disposed within the grip, the grip having a second strap receiving opening, the recessed compartment having a pair of mating apertures adapted to receive the snap-type hooks when the clip is lockingly engaged to the grip, wherein the first and the second strap receiving openings are bisected by a first plane having a longitudinal axis connecting center points of the first opening and the second opening, wherein when the inclined surfaces of the center projection of the clip cooperate with the internal guide surfaces within the grip, a combined structure of the clip and the grip forms a slight radius of curvature disposed along a second curved plane that is substantially perpendicular to the first plane, wherein the slight radius of curvature of the handle and the rounded edges are ergonomic and comfortably received in the palm of the user.

10. The curved handle as recited in claim 9, wherein the pair of snap-type hooks comprises a pair of locking elements disposed at an end thereof.

11. The curved handle as recited in claim 10, wherein the recessed compartment further comprises an internal surface adapted to engage the snap-type hooks to align and guide the clip into the recessed compartment.

12. The curved handle as recited in claim 9, wherein the clip contains a radius of curvature substantially equal to the radius of curvature of the grip along the second curved planar surface substantially perpendicular to the first flat planar surface having the longitudinal axis.

13. A curved handle for a strap, comprising:

a clip having a first strap receiving opening at a first distal end, and a base with a center projection extending outward therefrom, the center projection having opposing inclined surfaces; the clip having first and second snap-type hooks, the first snap-type hook having a first radius of curvature and the second snap-type hook having a second radius of curvature along a first surface; and a grip having rounded edges and a length substantially long enough to be received by a palm of a user, the grip having a second strap receiving opening at a second distal end, the grip also having a recessed compartment adapted to receive the clip, the recessed compartment having internal guide surfaces that cooperate with the inclined surfaces of the center projection, the recessed compartment further having a pair of mating apertures adapted to receive the snap-type hooks, wherein the first and second strap receiving openings are bisected by a first plane having a longitudinal axis connecting center points of the first opening and the second opening, wherein the first radius of curvature and the second radius of curvature are substantially equal.

14. The curved handle as recited in claim 13, wherein the first strap receiving opening is disposed in a base of the clip disposed opposite of the snap-type hooks and the second strap receiving opening is disposed opposite the recessed compartment.

15. The curved handle as recited in claim 13, wherein the pair of snap-type hooks comprises a pair of locking elements disposed at an end thereof.

16. The curved handle as recited in claim 13, wherein the recessed compartment further comprises a pair of mating apertures, the guide surfaces engaging the center projection of the clip to properly align the snap-type hooks with the mating apertures.

* * * * *